US010822831B2

(12) United States Patent
Wang

(10) Patent No.: US 10,822,831 B2
(45) Date of Patent: Nov. 3, 2020

(54) MAGNETIC CHILD SAFETY CABINET LOCK

(71) Applicant: Xinjun Wang, Zhejiang (CN)

(72) Inventor: Xinjun Wang, Zhejiang (CN)

( * ) Notice: Subject to any disclaimer, the term of this patent is extended or adjusted under 35 U.S.C. 154(b) by 13 days.

(21) Appl. No.: 16/075,742

(22) PCT Filed: Sep. 26, 2016

(86) PCT No.: PCT/CN2016/100106

§ 371 (c)(1),
(2) Date: Aug. 6, 2018

(87) PCT Pub. No.: WO2018/028028

PCT Pub. Date: Feb. 15, 2018

(65) Prior Publication Data

US 2019/0153746 A1 May 23, 2019

(30) Foreign Application Priority Data

Aug. 10, 2016 (CN) ..... 2016 1 0663030

(51) Int. Cl.

| | |
|---|---|
| ***E05B 13/02*** | (2006.01) |
| ***E05B 13/00*** | (2006.01) |
| ***E05B 65/44*** | (2006.01) |
| ***E05B 47/00*** | (2006.01) |

(Continued)

(52) U.S. Cl.

CPC ..... *E05B 13/002* (2013.01); *E05B 47/0045* (2013.01); *E05B 65/0014* (2013.01); *E05B 65/44* (2013.01); *E05B 67/003* (2013.01)

(58) Field of Classification Search

CPC .... E05B 13/002; E05B 47/0045; E05B 47/00; E05B 65/0014; E05B 65/44; E05B 65/003; E05B 65/52; E05B 19/18

USPC ... 70/207, 413, 14, 16, 18, 19, 57, 57.1, 58, 70/276; 292/251.5

See application file for complete search history.

(56) References Cited

U.S. PATENT DOCUMENTS 4,964,419 A * 10/1990 Karriker ..... E05B 75/00 128/878
5,230,541 A * 7/1993 Nowak ..... E05C 19/18 24/16 PB (Continued)

FOREIGN PATENT DOCUMENTS

CN 201170007 Y 12/2008
CN 203066680 U 7/2013

(Continued)

*Primary Examiner* — Suzanne L Barrett
(74) *Attorney, Agent, or Firm* — Global IP Services; Tianhua Gu

(57) ABSTRACT

A magnetic child safety cabinet lock comprises a magnetic key, a lock belt and a lock body. The lock body comprises a lock shell and a push button. The lock shell is provided with a lock magnet B. The push button is movably arranged in the lock shell. The push button is provided with a lock tooth and a locking mechanism. The locking mechanism is provided with a lock magnet A. One end of the lock belt is fixedly connected with the lock shell, and the other end can move freely. The lock belt is provided with a tooth groove matching with the lock tooth. The lock magnet B and the lock magnet A control the locking mechanism by magnetic force to make the push button locked and fixed.

6 Claims, 4 Drawing Sheets

(51) Int. Cl.
*E05B 65/00* (2006.01)
*E05B 67/00* (2006.01)

(56) References Cited

U.S. PATENT DOCUMENTS

| | | | | |
|---|---|---|---|---|
| 5,443,155 | A * | 8/1995 | Robinson | E05B 75/00 128/879 |
| 5,485,733 | A * | 1/1996 | Hoffman | E05B 47/004 70/276 |
| 6,609,399 | B1 * | 8/2003 | Daniels, Jr. | B62H 5/003 70/14 |
| 6,957,503 | B2 * | 10/2005 | De Paoli | A43B 1/0054 36/67 D |
| 8,156,771 | B2 * | 4/2012 | Kostal | E05B 75/00 70/16 |
| 8,499,595 | B2 * | 8/2013 | Zhang | E05B 45/005 70/49 |
| 8,746,415 | B2 * | 6/2014 | Aluisetti | B66B 1/468 187/391 |
| 8,978,427 | B2 * | 3/2015 | Ho | E05B 73/0017 70/14 |
| 10,226,104 | B2 * | 3/2019 | Aihara | A41F 1/002 |
| 2008/0047307 | A1 * | 2/2008 | Kenney | E05B 75/00 70/16 |
| 2013/0285388 | A1 | 10/2013 | Bishop | |
| 2015/0267447 | A1 | 9/2015 | Wheelwright | |

FOREIGN PATENT DOCUMENTS

| | | |
|---|---|---|
| CN | 204152348 U | 2/2015 |
| CN | 105781257 A | 7/2016 |

* cited by examiner

MAGNETIC CHILD SAFETY CABINET LOCK

CROSS REFERENCE TO RELATED PATENT APPLICATION

The present application is the US national stage of PCT/CN2016/100106 filed on Sep. 26, 2016, which claims the priority of the Chinese patent application No. CN201610663030.X filed on Aug. 10, 2016, which application is incorporated herein by reference.

TECHNICAL FIELD OF THE INVENTION

The present invention mainly relates to the technical field of child safety lock, in particular to a magnetic child safety cabinet lock.

BACKGROUND OF THE INVENTION

As babies grow up, they become more and more curious about the world. In life, babies will often rummage through cabinets, leading to some unwanted dangers. Child safety locks can prevent babies from arbitrarily opening the doors of cabinet, refrigerator and microwave oven as well as drawers in the house, disturbing articles, and accidentally eat or use of dangerous medicine, knives, etc.

At present, all kinds of child safety cabinet locks on market generally have the following defects:

1, The design is simple, so the lock is easy to be unlocked by a baby, thus losing the original function as a protection lock.

2, The lock need to be operated by both hands, so it is laborious to open and inconvenient to use.

3, When used, the lock need to be taken off, so it is easy to lose and inconvenient to use.

4, The whole structure is complex, the cost is high, the assembly process is complex, and the use reliability is low.

5, When installed, the lock is usually fixed by screws or adhesive, which can produce certain damage to furniture.

SUMMARY OF THE INVENTION

In order to avoid the defects of the prior art, in combination with the prior art and based on the practical application, the present invention provides a magnetic child safety cabinet lock which has simple structure, is safe and reliable, can be operated by one hand, is flexible to use, and is easy and convenient to install without the need of damaging the furniture.

To achieve the above purpose, the present invention adopts the following technical solution:

A magnetic child safety cabinet lock, comprising a magnetic key, a lock belt and a lock body. The lock body comprises a lock shell and a push button. The lock shell is provided with a lock magnet B. The push button is movably arranged in the lock shell. The push button is provided with a lock tooth and a locking mechanism. The locking mechanism is provided with a lock magnet A. One end of the lock belt is fixedly connected with the lock shell, and the other end can move freely. The lock belt is provided with a tooth groove matching with the lock tooth. The lock magnet B and the lock magnet A control the locking mechanism by magnetic force to make the push button locked and fixed. The movable end of the lock belt extends into the lock shell to make the tooth groove and the lock tooth matched to realize the locking function of the lock body. After the magnetic key is inserted, the magnetic key and the lock magnet A control the locking mechanism by magnetic force to make the push button unlocked. The movable push button drives the lock tooth to move and makes the lock tooth separate from the tooth groove in the lock belt to realize the unlocking function of the lock body.

The locking mechanism comprises a lock valve and a baffle, one end of the lock valve is swingably installed on the push button, the baffle is fixed on the lock shell, the lock magnet A is installed in the lock valve, the swing position of the lock valve is controlled by magnetic force, and the lock valve is matched with the baffle to realize the locking and unlocking of the push button.

The push button is also provided with a spring which acts on the lock tooth to make the lock tooth engaged with the tooth groove of the lock belt.

The lock tooth and the tooth groove have bevels matched with each other.

The lock shell has two upper belt holes and two lower belt holes, the two upper belt holes are formed in the upper part of the lock shell on both sides, the two lower belt holes are formed in the lock shell on both sides and below the upper belt holes, the fixed end of the lock belt is arranged in the lower belt hole on one side of the lock shell, and the movable end of the lock belt passes through the two upper belt holes respectively in use and extends into the lock shell through the lower belt hole on the other side of the lock shell to realize locking.

The lock shell has clamping grooves at the upper and the lower belt holes, the fixed end of the lock belt is provided with a clamping head, and the fixed end of the lock belt is fixed by the matching between the clamping head and the clamping grooves.

The lock shell comprises a front lock shell and a back lock shell which are fixed together by ultrasonic welding, clips, glue or screws.

The present invention has the following beneficial effects:

1. The present invention adopts push button type secondary locking protection and realizes locking by the attracting and repelling functions between magnets, which is safe and reliable, can be unlocked by one hand, is flexible to use, and solves the contradiction between simple and convenient use and unlocking prevention.

2. The present invention adopts unique swing design of lock valve to make the function more simple and reliable.

3. The present invention adopts the design of single lock belt with double rings and realizes the function of double lock belts on the basis of reducing production and process cost. In addition, the lock does not need to be removed after unlocked, and can be hung on the handle on one side of the lock to prevent loss and be convenient to use.

4. The present invention adopts a special double-lock-magnet structure to reduce the requirement of the attraction strength of the magnetic key, reduce the overall cost, simplify the assembly process and improve the reliability.

5. The present invention is simple and convenient to install without damaging the furniture, especially for users who do not like to use adhesive or screw fixation.

Figure 1:
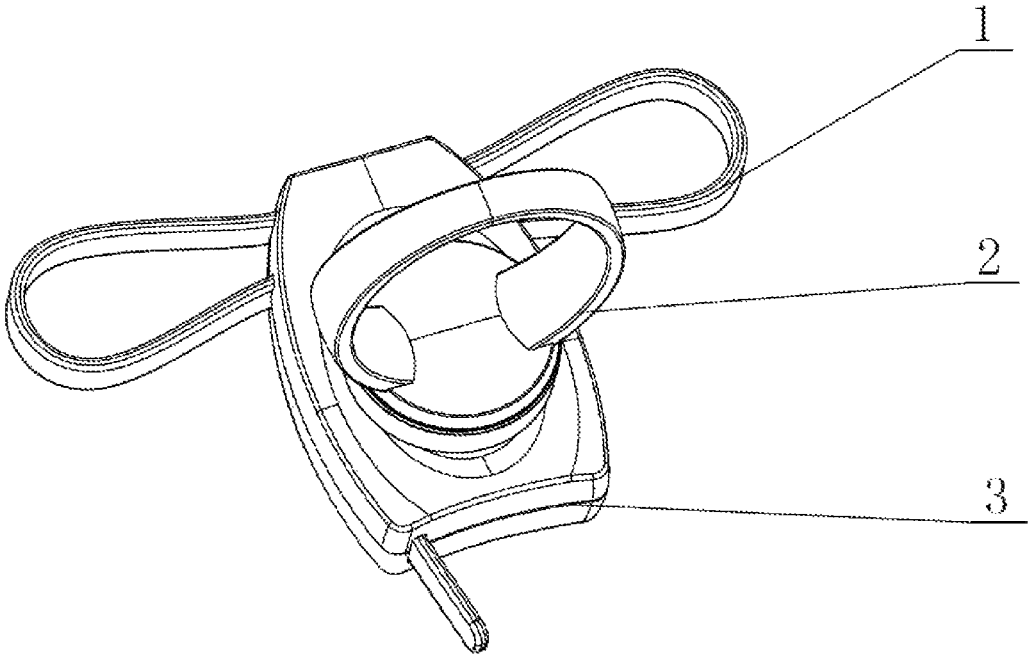
FIG. 1 is an overall structural schematic diagram of the present invention.

Legends shown in the Figures are as follows: 1. lock belt; 11. tooth groove; 2. magnetic key; 3. lock body; 31. front lock shell; 32. push button; 33. spring; 34. lock valve; 35. lock magnet A; 36. lock magnet B; 37. back lock shell; 38. lock tooth; 39. baffle.

DETAILED DESCRIPTION OF THE INVENTION

The present invention will be further described in detail below in combination with the drawings and embodiments. It should be understood that the embodiments are only used for illustrating the present invention, not used for limiting the scope of the present invention. In addition, it should be understood that those skilled in the art could, after reading the content of the present invention, implement various modifications to and variations of the present invention, and such equivalent forms also fall within the scope defined by the present application.

As shown in the figures, a magnetic child safety cabinet lock, comprising a magnetic key 2, a lock belt 1 and a lock body 3. The lock body 3 comprises a lock shell and a push button 32. The lock shell is provided with a lock magnet B 36. The push button 32 is movably arranged in the lock shell. The push button 32 is provided with a lock tooth 38 and a locking mechanism. The locking mechanism is provided with a lock magnet A 35. One end of the lock belt 1 is fixedly connected with the lock shell, and the other end can move freely. The lock belt 1 is provided with a tooth groove 11 matching with the lock tooth 38. The lock magnet B 36 and the lock magnet A 35 control the locking mechanism by magnetic force to make the push button 32 locked and fixed. The movable end of the lock belt 1 extends into the lock shell to make the tooth groove 11 and the lock tooth 38 matched to realize the locking function of the lock body 3. After the magnetic key 2 is inserted, the magnetic key 2 and the lock magnet A 35 control the locking mechanism by magnetic force to make the push button 32 unlocked. The movable push button 32 drives the lock tooth 38 to move and makes the lock tooth 38 separate from the tooth groove 11 in the lock belt 1 to realize the unlocking function of the lock body 3.

Figure 4:
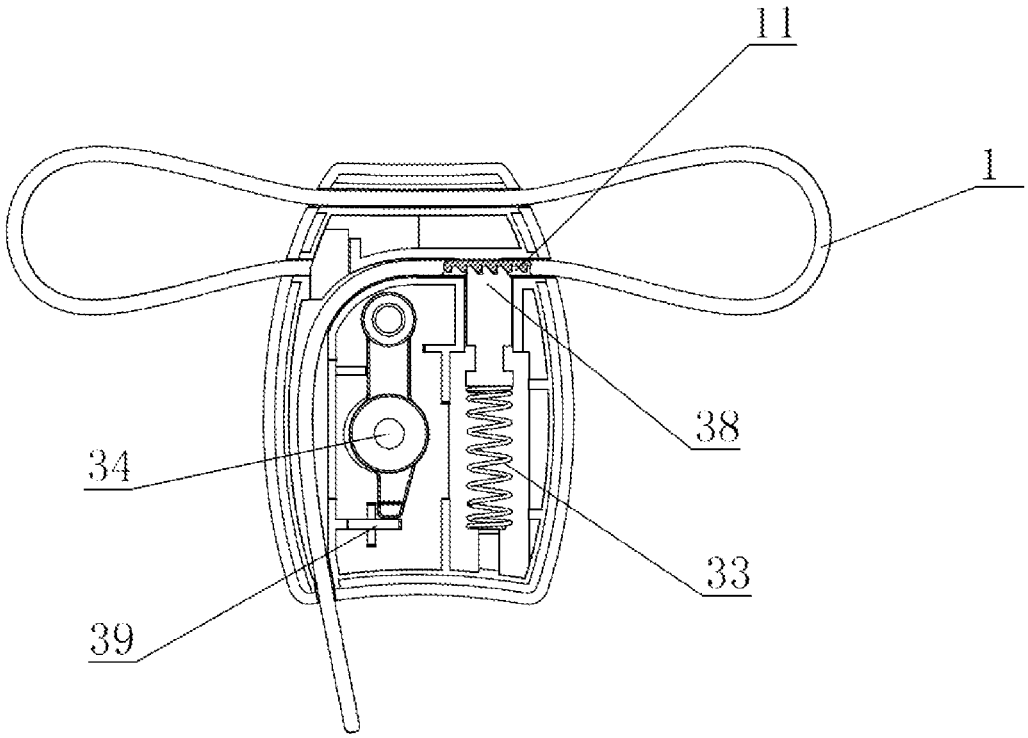
FIG. 4 is a structural schematic diagram of the present invention in locking state.
Figure 5:
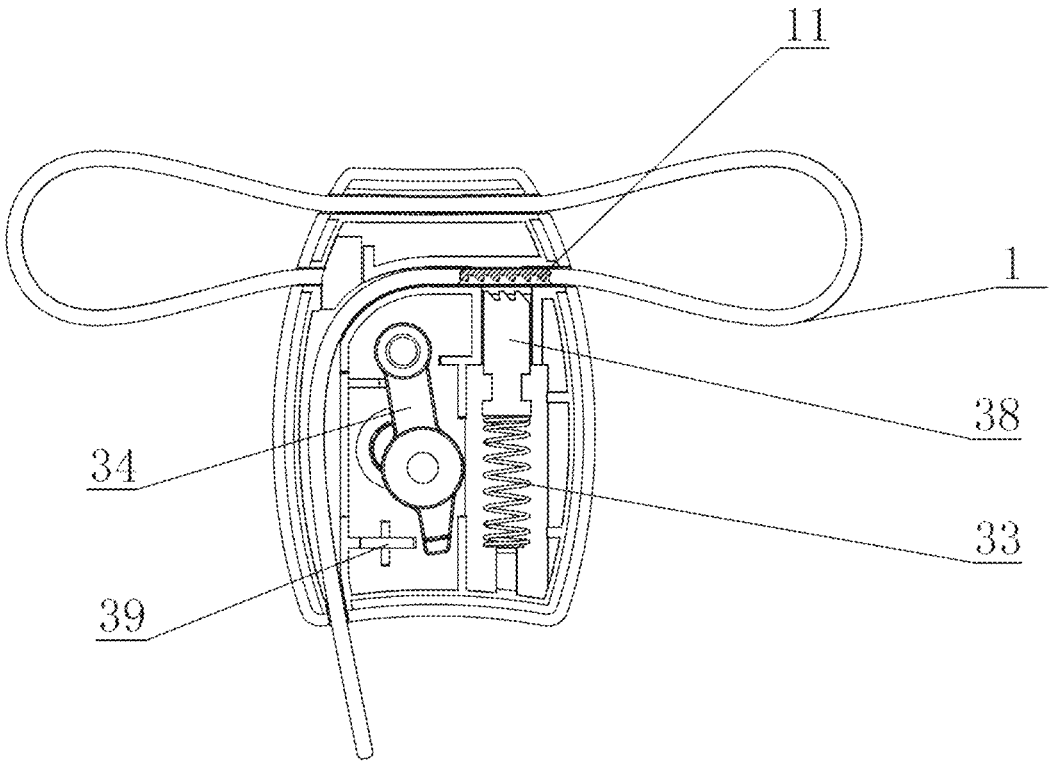
FIG. 5 is a structural schematic diagram of the present invention in unlocking state.
Figure 6:
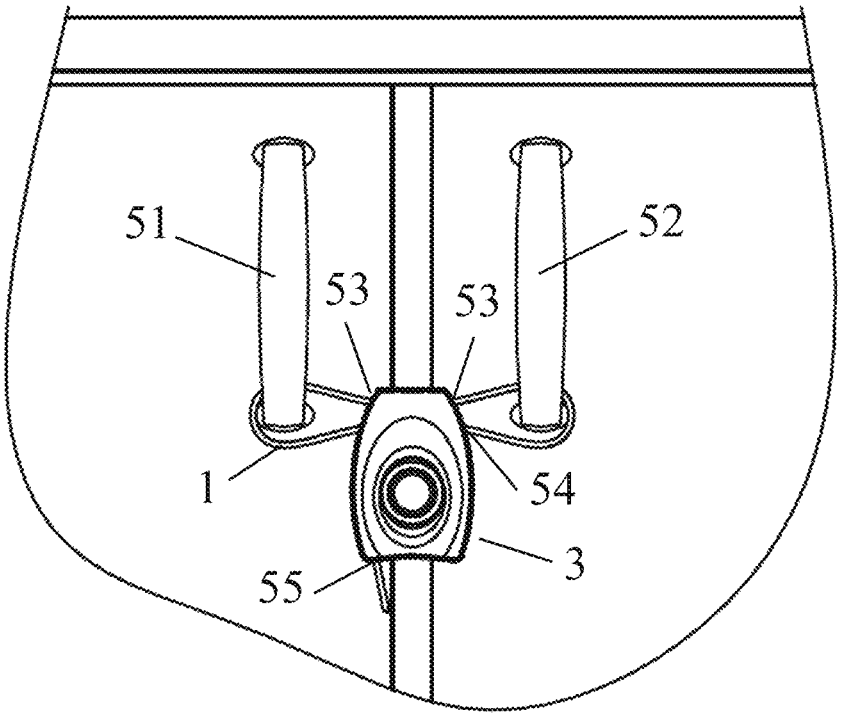
FIG. 6 is a schematic diagram of the present invention in actual use.

As shown in FIG. 6, the present invention is applicable to cabinet doors with handles. When used, the lock belt is wrapped around the cabinet handles to lock the cabinet. The push button 32 of the present invention moves up and down in the lock shell, the locking mechanism is used for locking and unlocking the push button 32, and the installation location of the magnetic key is different from that of the lock magnet B 36. When the magnetic key 2 is removed, only the magnetic force between lock magnet A 35 and lock magnet B 36 exists in the lock body 3. This magnetic force controls the movement of the lock mechanism to lock the push button 32; at this point, the lock tooth 38 is engaged with the tooth groove 11 in the lock belt 1, so that the movable end of the lock belt 1 cannot be removed from the lock shell, and the lock body 3 can be locked, as shown in FIG. 4. When the magnetic key 2 is inserted, a magnetic force is generated between the magnetic key 2 and the lock magnet A 35, and this magnetic force is greater than that between the lock magnetic A 35 and the lock magnet B 36, so that the magnetic force between the magnetic key 2 and the lock magnet A 35 can drive the lock mechanism to move, and the lock mechanism can unlock the push button 32. The push button 32 can slide up and down freely, so when the push button 32 is pulled down, the lock tooth 38 moves down with the push button 32 and is separate from the tooth groove 11; at this point, the lock belt 1 can be pulled out from the lock shell, so that lock body 3 can be unlocked. The present invention is designed according to the principle of attraction and repulsion between permanent strong magnets, which can make the lock safer and more beautiful without damaging the original furniture, cannot be cracked by a baby, and even can be used to guard against theft. In addition, the present invention is convenient to install (it can be easily installed without any tools), and is also convenient to use. The lock can be unlocked as long as the magnetic key 2 is gently inserted and pulled back, and the lock can be unlocked by one hand.

Figure 2:
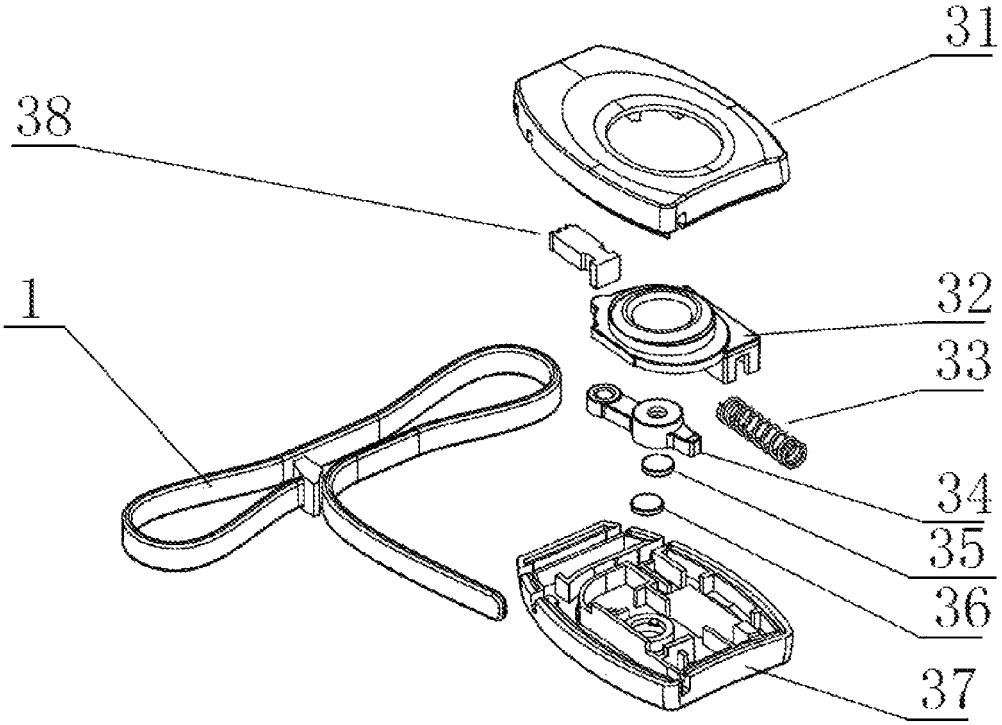
FIG. 2 is a front structural schematic diagram of the breakdown of the present invention.
Figure 3:
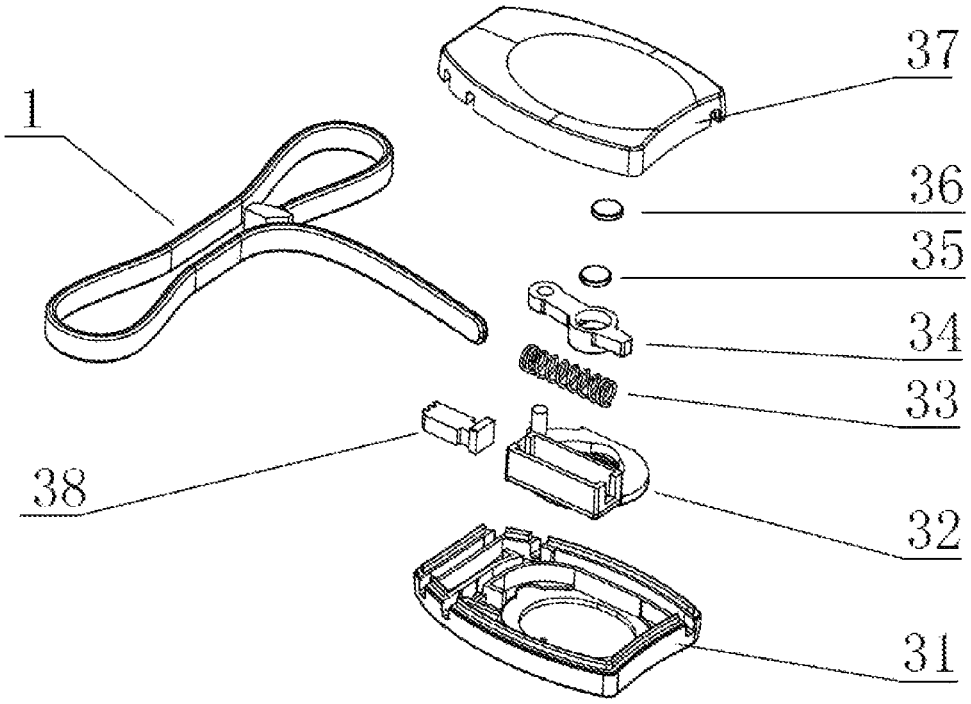
FIG. 3 is a back structural schematic diagram of the breakdown of the present invention.

The locking mechanism of the present invention comprises a lock valve 34 and a baffle 39, one end of the lock valve 34 is swingably installed on the push button 32, the baffle 39 is fixed on the lock shell, the lock magnet A 35 is installed in the lock valve 34, the swing position of the lock valve 34 is controlled by magnetic force, and the lock valve 34 is matched with the baffle 39 to realize the locking and unlocking of the push button 32. As shown in FIGS. 2 and 3, the push button 32 is provided with an installation post; one end of the lock valve 34 is provided with a through hole which is matched with the installation post, and the other end is provided with an installation groove used for installing the lock magnet A 35; after installed on the installation post, the lock valve 34 can swing centering on the installation post; when the lock magnet A 35 operates with the lock magnet B 36, the lock valve 34 swings to the baffle 39 to make the push button 32 locked; when the lock magnet A 35 operates with the magnetic key 2, the lock valve 34 swings to the side of the baffle 39, allowing the push button 32 to move freely.

The push button 32 of the present invention is also provided with a spring 33 which acts on the lock tooth 38 to make the lock tooth 38 engaged with the tooth groove 11 of the lock belt 1. The lock tooth 38 and the tooth groove 11 have bevels matched with each other. The lock tooth 38 is push up by the acting force of the spring 33 to be engaged with the tooth groove 11 of the lock belt 1, and when the lock belt 1 is inserted, the spring 33 is compressed to facilitate the insertion of the lock belt 1.

The lock shell of the present invention has two upper belt holes and two lower belt holes, the two upper belt holes are formed in the upper part of the lock shell on both sides, the two lower belt holes are formed in the lock shell on both sides and below the upper belt holes, the fixed end of the lock belt 1 is arranged in the lower belt hole on one side of the lock shell, and the movable end of the lock belt 1 passes through the two upper belt holes respectively in use and extends into the lock shell through the lower belt hole on the other side of the lock shell to realize locking. When the present invention is used, one end of the lock belt 1 successively passes through the inner side of a handle ring 51, the upper belt holes 53 of the lock body 3, the other side of the handle ring 52, and the lower belt holes 54, 55 of the lock body 3, and then the lock belt 1 is tightened and locked. The present invention adopts the design of single lock belt with double handle rings 51, 52 and realizes the function of double lock belts on the basis of reducing production and process cost; the lock does not need to be removed after unlocked, and can be hung on the handle on one side of the lock to prevent loss and be convenient to use.

The lock shell of the present invention has clamping grooves at the upper and the lower belt holes, the fixed end of the lock belt 1 is provided with a clamping head, and the fixed end of the lock belt 1 is fixed by the matching between the clamping head and the clamping grooves. The lock shell comprises a front lock shell 31 and a back lock shell 37 which are fixed together by ultrasonic welding, clips, glue or screws. The assembly process of the present invention is simplified by the design of the clamping grooves and the clamping head as well as the design of the front lock shell 31 and the back lock shell 37.

Figure 7:
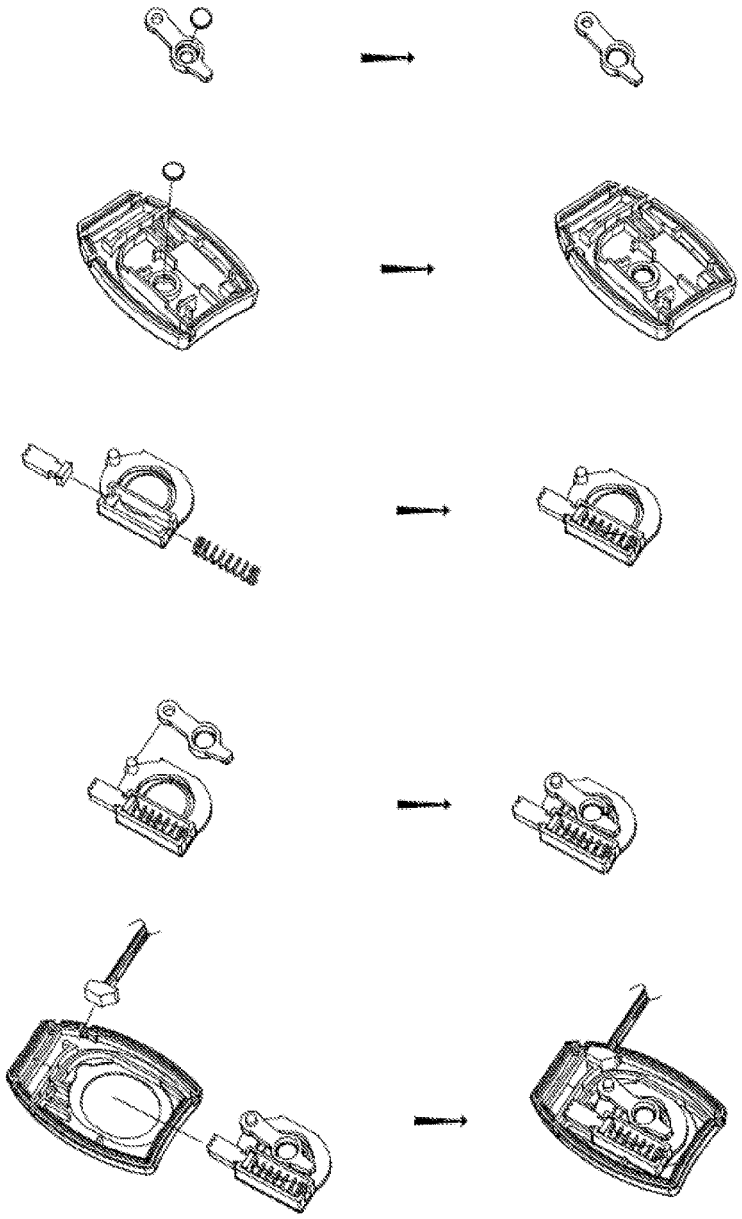
FIG. 7 is a schematic diagram of the present invention in assembly process.

As shown in FIG. 7, specific assembly method and installation steps of the present invention are as follows:

1. The lock magnet A 35 is installed in the lock valve 34 to form a lock valve assembly;
2. The lock magnet B 36 is installed in the back lock shell 37 to form a back lock shell assembly;
3. The lock tooth 38 is installed in one end of the push button 32, and then the spring 33 is installed in a spring groove in the push button 32;
4. The lock valve assembly is installed in the push button 32 to form a push button assembly;
5. The lock belt 1 is installed in the front lock shell 31, and then the push button assembly is installed in the front lock shell 31; and
6. The back lock shell assembly is installed and fixed by ultrasonic welding, glue or screws.

What is claimed is:

1. A magnetic child safety cabinet lock, comprising a magnetic key (2), a lock belt (1) and a lock body (3), wherein the lock body (3) comprises a lock shell and a push button (32); the lock shell is provided with a lock magnet B (36); the push button (32) is movably arranged in the lock shell; the push button (32) is provided with a lock tooth (38) and a locking mechanism; the locking mechanism is provided with a lock magnet A (35); one end of the lock belt (1) is fixedly connected with the lock shell, and the other end can move freely; the lock belt (1) is provided with a tooth groove (11) matching with the lock tooth (38); the lock magnet B (36) and the lock magnet A (35) control the locking mechanism by magnetic force to make the push button (32) locked and fixed; the movable end of the lock belt (1) extends into the lock shell to make the tooth groove (11) and the lock tooth (38) matched to realize the locking function of the lock body (3); after the magnetic key (2) is inserted, the magnetic key (2) and the lock magnet A (35) control the locking mechanism by magnetic force to make the push button (32) unlocked; and the movable push button (32) drives the lock tooth (38) to move and makes the lock tooth (38) separate from the tooth groove (11) in the lock belt (1) to realize the unlocking function of the lock body (3);

wherein the lock shell has two upper belt holes and two lower belt holes, the two upper belt holes are formed in the upper part of the lock shell on both sides, the two lower belt holes are formed in the lock shell on both sides and below the upper belt holes, the fixed end of the lock belt (1) is arranged in the lower belt hole on one side of the lock shell, and the movable end of the lock belt (1) passes through the two upper belt holes respectively in use and extends into the lock shell through the lower belt hole on the other side of the lock shell to realize locking.

2. The magnetic child safety cabinet lock of claim 1, wherein the locking mechanism comprises a lock valve (34) and a baffle (39), one end of the lock valve (34) is swingably installed on the push button (32), the baffle (39) is fixed on the lock shell, the lock magnet A (35) is installed in the lock valve (34), the swing position of the lock valve (34) is controlled by magnetic force, and the lock valve (34) is matched with the baffle (39) to realize the locking and unlocking of the push button (32).

3. The magnetic child safety cabinet lock of claim 1, wherein the push button (32) is also provided with a spring (33) which acts on the lock tooth (38) to make the lock tooth (38) engaged with the tooth groove (11) of the lock belt (1).

4. The magnetic child safety cabinet lock of claim 3, wherein the lock tooth (38) and the tooth groove (11) have bevels matched with each other.

5. The magnetic child safety cabinet lock of claim 1, wherein the lock shell has clamping grooves at the upper and the lower belt holes, the fixed end of the lock belt (1) is provided with a clamping head, and the fixed end of the lock belt (1) is fixed by the matching between the clamping head and the clamping grooves.

6. The magnetic child safety cabinet lock of claim 1, wherein the lock shell comprises a front lock shell (31) and a back lock shell (37) which are fixed together by ultrasonic welding, clips, glue or screws.

* * * * *